United States Patent [19]

Fish

[11] 4,171,741

[45] Oct. 23, 1979

[54] PACKAGING CARTON CONSTRUCTION

[75] Inventor: Darrell D. Fish, Baltimore, Md.

[73] Assignee: Universal Synergetics, Pennsauken, N.J.

[21] Appl. No.: 879,733

[22] Filed: Feb. 21, 1978

[51] Int. Cl.[2] ..... B65D 85/68; B65D 19/06

[52] U.S. Cl. ..... 206/335; 217/43 A; 206/386; 229/23 C

[58] Field of Search ..... 206/335, 320, 386, 600; 229/23 C; 217/43 A

[56] References Cited

U.S. PATENT DOCUMENTS

| | | | |
|---|---|---|---|
| 2,822,971 | 2/1958 | Elmendorf | 229/23 C |
| 2,854,165 | 9/1958 | Foster et al. | 217/43 A |
| 2,910,221 | 10/1959 | Whiton | 229/23 C |
| 3,675,765 | 7/1972 | Melsek | 206/320 |
| 3,688,968 | 9/1972 | Rathfon | 229/23 C |

FOREIGN PATENT DOCUMENTS

| | | | |
|---|---|---|---|
| 2241039 | 2/1974 | Fed. Rep. of Germany | 206/335 |

*Primary Examiner*—William T. Dixson, Jr.

[57] ABSTRACT

Large heavy objects, such as garden tractors, other wheeled vehicles and non-wheeled objects are packaged in a carton which includes a rectangular skid or frame formed of elongated structural members, preferably wood, arranged with two spaced parallel side members (footings) and a plurality of cross members extending therebetween. Some of said cross members (slats) are attached to the underneath surface of the side members while others of the cross members (chocks) are attached to the top surface of the side members at points spaced inwardly a prescribed distance from the outermost of the slats lying therebeneath. A cover member formed from some conventional material such as corrugated cardboard includes an opposed pair of side walls connected by an opposed pair of end walls, and a pair of upper major side flaps and upper minor side flaps attached to and extending upwardly from the upper edge of said side and end walls respectively. The lower edge of the cover member is preferably without flaps and is secured to the side members of the skid by means of corrugated runners attached to the undersurface of the skid and which fold up around the lower edges of the cover after it is assembled and are then stitched to the skid.

The inner walls of the cover are provided with vertical structural members (posts) secured thereto and which extend from a point near the top edge thereof to a point closely adjacent the bottom edge thereof. A plurality of transverse bridging cross members (beams) are secured to the minor flaps of the cover at points so designed that when assembled, folded and secured, the beams rest upon and extend between the upper ends of the posts so that there is a continuous structural vertical support member from top to bottom. Therefore substantial rigidity and support is provided for stacking a plurality of such cartons in warehouses or storage points.

5 Claims, 5 Drawing Figures

PACKAGING CARTON CONSTRUCTION

BACKGROUND OF THE INVENTION

Under contemporary merchandising and marketing techniques, it is usually essential that all items be individually packaged in some kind of carton. These cartons must be designed for strength and sturdiness in several respects. First of all the items within must be protected to some extent from the elements and dangers incurred during shipping and storage, such as dust, moisture, and the like. In addition, the items must be so packaged as to withstand bumps, scrapes and other accidental knocking around which occurs as a result of shipping and handling during the merchandising thereof. Any packaging should be so designed and constructed as to allow stacking of the cartons for more efficient use of warehouse and storage space. Even such items as lawn tractors are now marketed in individual cartons and should be placed in cartons of such strength and rigidity that four or five of the cartons may be stacked one atop the other without harm to the tractors within or without causing breakdown of the cartons.

Aside from the aspects of strength and sturdiness, the cartons must be easily movable either by lift trucks of the fork-lift type or of the squeeze type, as some merchandising centers will use fork trucks while others may use lift trucks that squeeze against the ends or sides of cartons to pick them up.

The cartons must be engineered and designed to achieve the considerations set forth hereinabove while at the same time they must be capable of being manufactured economically because in most cases such cartons are thrown away after one use. Frequently it is desirable to open the carton to add parts initially omitted. Finally manufacturing facilities want a packaging system which can be loaded and secured with a minimum of time and labor.

SUMMARY OF THE PRESENT INVENTION

The present invention then is directed to a unique type of packaging carton construction for large heavy objects and particularly suitable for such articles as wheeled vehicles and the like. In general, the carton construction is so fabricated as to be supplied to the manufacturer as a pair of subassemblies, the first subassembly being a rectangular skid formed by a pair of side members and a plurality of cross members connecting the two side members, and the second subassembly being a cover member which is so designed as to fit around the rectangular skid and which includes a plurality of vertical bracing members attached thereto, which when assembled to the skid provide a continuous vertical structural support between the top and bottom of the carton.

The skid itself is so designed as to resist twisting or skewing, and the cross members are intentionally spaced and arranged as to aid in the loading of the article thereon as well as distributing the weight of the article equally around the skid.

The cover includes a pair of side walls, end walls, and upper major and minor flaps. No flaps extend from the lower edges of side and end walls, however, because all securing of the cover in the bottom area is through the lower side and end walls. A plurality of vertical posts or structural members are secured to the inside walls of the cover at positions spaced from the ends thereof a distance corresponding to the distance the outermost lower cross members or slats are spaced from the ends of the side pieces of the skid, so that a continuous vertical structural column from top to bottom of the completed carton is formed upon assembly. The structural post members within the cover are spaced from the corners thereof so that a blow against the corner will not damage the structural support of the carton. An additional wooden or structural strip is placed on the interior of each minor flap in such a position that when the flap is folded over, the strip engages the upper ends of corresponding post or structural members secured to the inside of the cover.

A unique first securing means in the form of a pair of side runners are attached to the underneath side of the skid and fold up over the lower side edges of the cover to secure the cover to the skid. Upon folding and assembly then, the runners support and elevate the skid slightly from the floor to allow the tynes of a fork-lift truck to slip thereunder to lift the carton during handling thereof. In the skid itself, the spacing of the slats beneath the side members are such that the forks of a forklift truck engage and support at least one cross member on the opposite side of the center of gravity regardless of which end the fork-lift truck approaches the carton so that the tynes of the fork-lift truck always extend past the center of gravity to provide proper support during lifting of one or two cartons. The chocks are arranged with respect to the outermost slats to initially engage the tires of the vehicle being loaded and are spaced according to the wheelbase to prevent rolling of the vehicle after loading. By providing the chocks on top of the side members the chocking location is raised to mount the vehicle higher in the carton and maintain it above the floor or carton beneath.

It is therefore an object of the present invention to provide an improved package carton construction for large objects such as wheeled vehicles and the like, which is considerably improved as far as strength, structural rigidity, ease of loading, are concerned.

It is another object of the present invention to provide an improved packaging carton of the type described which mounts the vehicle on a skid, which skid is considerably stronger and provides surer positioning of the vehicle thereon.

It is yet another object of the present invention to provide a packaging carton of the type described in which, once the carton is completed, vertical interior support members connecting the upper edge of the carton with the skid provide a continuous vertical structural pier or pillar between the top and bottom of the carton.

It is another object of the present invention to provide a carton construction of the type described including a vertical pier or pillar which is self aligning, and that upon assembly is automatically formed and bottoms out on the skid perfectly every time.

It is still a further object of the present invention to provide a packaging carton of the type described which includes no closure seams underneath and thereby permits temporary opening thereof after substantial assembly either at the top or bottom to place therein parts which may have been omitted either inadvertently or intentionally during the manufacture of the item which is packaged inside.

Other objects and a fuller understanding of the invention will become apparent upon reading the following detailed description of a preferred embodiment along with the accompanying drawings in which.

DETAILED DESCRIPTION OF A PREFERRED EMBODIMENT

Figure 1:
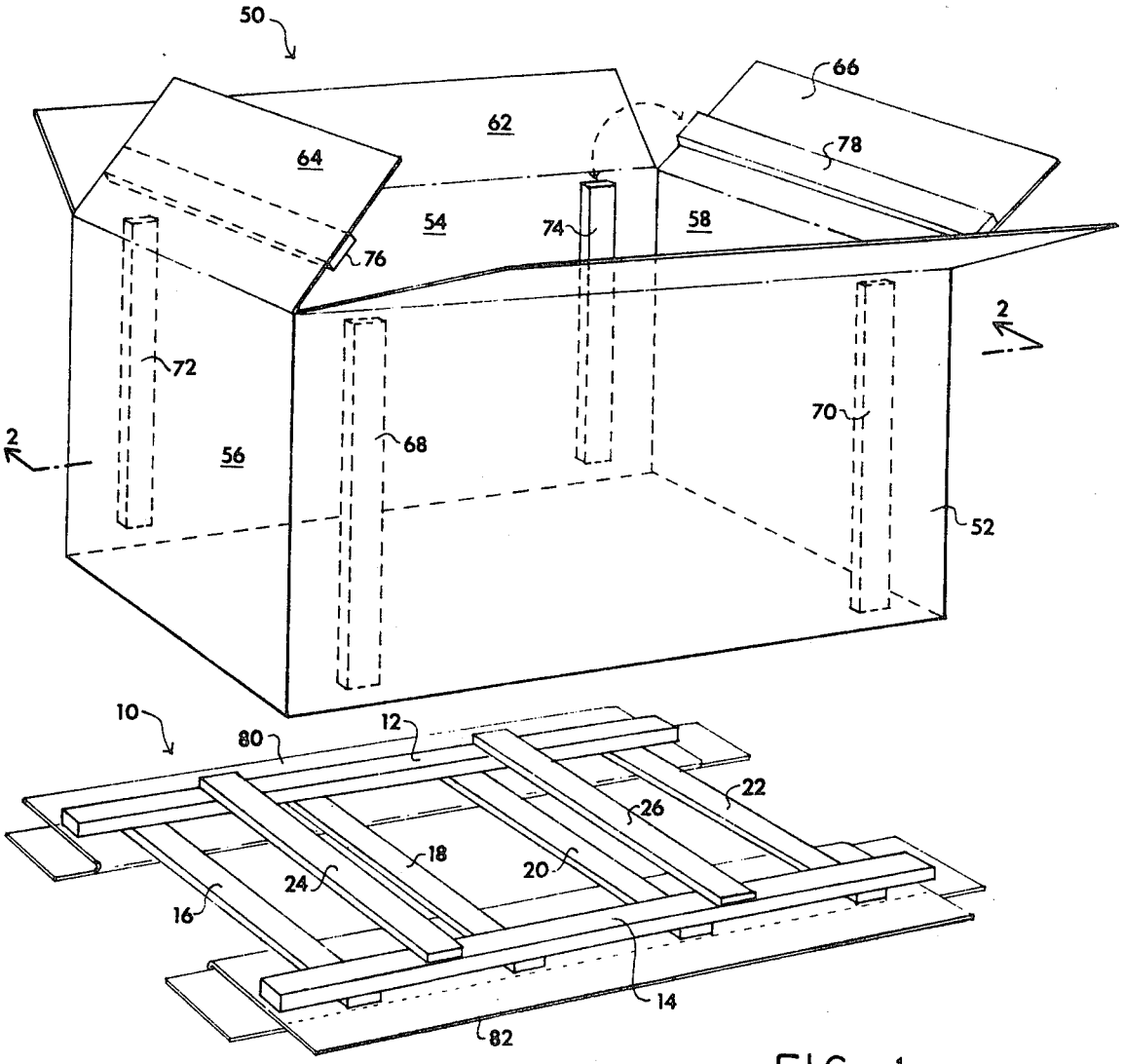
FIG. 1 is an exploded perspective view illustrating the packaging carton according to the present invention.

Turning now to the drawings, and particularly FIG. 1, the packaging carton construction according to the present invention includes basically a rectangular wooden skid 10 (wood is preferred but other materials may be used) and a cover member 50 formed of corrugated cardboard or some similar material which may be easily and quickly assembled onto the skid after the vehicle or other heavy object has been placed thereon and secured thereto by stapling along the sides and end. The unique construction of the skid 10 and carton 50 provide the results described hereinabove and below.

Figure 2:
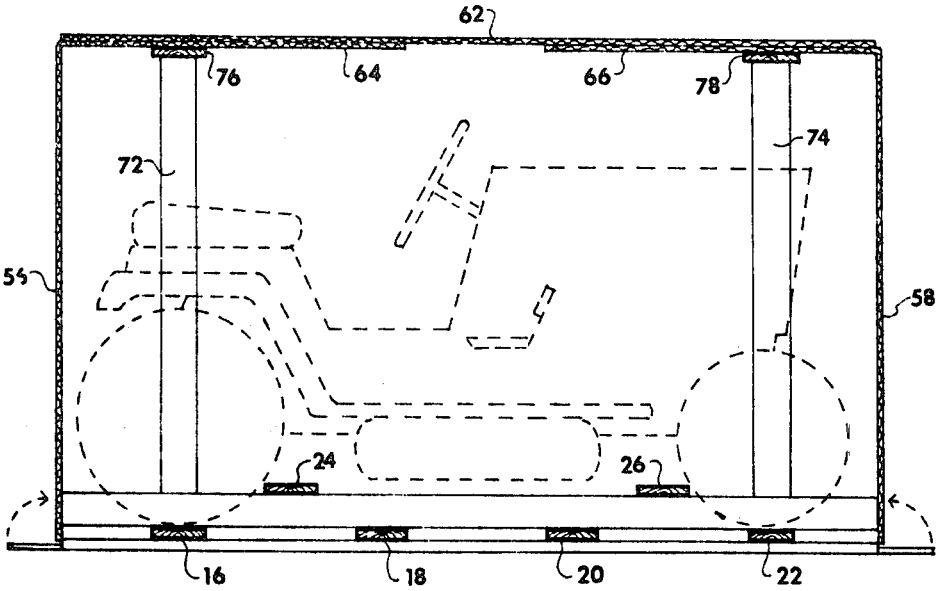
FIG. 2 is a sectional view taken substantially along lines 2—2 in FIG. 1 except illustrating the carton as being closed and assembled.

Turning now to FIG. 1, the skid itself is formed of a pair of spaced, parallel side members, preferably structural wooden members, either two-by-fours or two-by-threes. Side members 12,14 are joined by a plurality of lower cross members or slats 16, 18, 20, 22 and a pair of upper cross members or chocks 24,26. These cross members may be formed of a lighter weight material such as one-by-fours. The spacing and arrangement of the outer slats 16,22 and the upper chocks 24,26 is selected in accordance with the wheelbase of the vehicle mounted therein, where such carton is used for vehicles. So arranged the front wheels of the vehicle will rest against the opposed facing edges of slat 16 and upper chock 24 and the rear wheels will rest between the opposed facing edges of slat 22 and upper chock 26 (FIG. 2). It should here be pointed out that the front and rear wheels could be reversed, as this skid is entirely symmetrical and the vehicle may be moved thereonto from either direction. Additionally, the spacing of the lower intermediate slats 18,20 is somewhat critical in that although each of these members are on opposite sides of the center of gravity of the carton, each should be spaced from the far end of the carton by no more than forty-two inches, which is the length of the tynes of a standard fork truck. So arranged, when the tynes of the fork-lift truck are slipped beneath the carton, they will engage a portion past the center of gravity so that the carton will not tip off when being lifted.

Further, the utilization of a first plurality of slats 16, 18, 20, 22 beneath the side members 12,14 and the additional use of upper chocks 24,26 provide better stabilization for the entire skid or pallet. The skid is reinforced to prevent twisting, and the weight is better distributed throughout. Utilizing the chocks or cross members 24,26 on top of the side members 12,14 further provides a higher chocking location so that the crated vehicle is situated higher in the carton. This may not be so important when the carton is on the floor; however, when it is placed atop another carton it is desirable to maintain the wheels of the higher cartons out of substantial pressure engagement with the cartons therebelow, so that the weight is carried by the framework or pier structure of the carton. Further, the lateral spacing between side members 12,14 is such that the cartons can be lifted from either side with a fork-lift also. That is, when the fork-lift truck is moved up against one side of the carton the tynes thereof will engage at least a portion of the opposite side rail structure.

Turning now to the cover member 50, there is illustrated as the preferred embodiment a half slotted corrugated member, which is a cover formed of corrugated cardboard in much the same manner as a box would be formed, except there are flaps on only one side thereof, the other or lower side edges terminating in straight edges. Preferably, the material for cover 50 is 350 pound test, double wall, corrugated cardboard or fiber board, although it should be realized that other materials could also be utilized within the scope of the invention.

The cover 50 is formed by an opposed pair of side walls 52,54 joined by an opposed pair of end walls 56,58. Extending upwardly from the upper edges of opposed side walls 52 and 54 are a pair of major flaps 60,62 respectively. Similarly, a pair of minor flaps 64,66 are attached to and extend upwardly from the upper edges of opposed end walls 56,58 respectively.

A pair of vertical, structural members or posts 68,70 are secured to the inner surface of side wall 52 at points spaced inwardly from the opposite ends thereof a distance of approximately seven inches although this dimension can vary. Likewise, a pair of posts 72,74 extend vertically against and are secured to the other of side walls 54 at similarly spaced positions from the ends thereof. The reasons for the spacing will become apparent hereinafter. Preferably, the posts 68,70,72,74 are formed of two-by-threes, although other substantially sturdy structural members can be utilized.

A horizontal or transverse strip, hereinafter called a beam, 76 is secured to the inner surface of minor flap 64 at a point spaced from the upper edge of side wall 56 a distance equal to the spacing of posts 68,72 from the ends of side walls 52,54 respectively. Likewise, another beam 78 is secured to the inner surface of minor flap 66 at a similar position with respect to posts 70 and 74. While the latter mentioned beams 76,78 may be of any of the variety of sizes, preferred size is one-by-four.

It should be noticed that the upper ends of all posts 68, 70, 72 and 74 terminate at a point spaced from the upper edge of side wall 52,54 a distance equal to the thickness (one inch) of beams 76,78. So arranged when the minor flaps 64,66 are closed, the beams 76,78 automatically position themselves against and in bearing relationship to the upper ends of the vertical posts 68–74.

When the cover is assembled over the skid or pallet 10, the posts 68 and 72 are vertically aligned with the opposite ends of slat 16. In a similar manner, posts 70 and 74 align with the ends of slat 22 (see FIG. 2). The lower ends of posts 68, 70, 72 and 74 are spaced above the lower edges of side walls 52, 54 a distance slightly less than the combined thickness of the corresponding ones of side members or footings 12,14 and slats 16,22. The purpose of this spacing is to insure abutment of the lower ends of posts 68, 70, 72 and 74 with footings 12,14 prior to the time the lower edges of side walls 52, 54 engage the floor or the runners 80,82 to be described hereinafter.

There has now been described the pallet or skid 10 and the cover member 50. The spacing or location of the post 68, 70, 72 and 74 from the respective corners of the cover member is for the purpose of preventing damage to the pier or frame structure in case of accidental thumping against the corners of the box. Since the posts are spaced from the corners damage to the corners will not cause damage to the posts which might be the case if the posts were exactly in the corners. Therefore the structural rigidity of the carton is not endangered by accidental bumping of objects against the corners. It should be noted that the side rails or footings 12,14 of skid 10 are of the same length as the length of side walls 52,54, so that longitudinal support for the carton is thereby provided. This longitudinal support allows gripping of the carton by squeezing against the opposite ends as is some times the case in material handling apparatuses. Further, a significant feature of the invention lies in the provision of the vertical structural post or column from top to bottom of each carton. When one carton is stacked on another the weight of the load in the upper carton will be transmitted through the frame structure, rather than through the carton walls, therebeneath to the floor so that no pressure, or at least minimal pressure is brought to bear against the corrugated cardborad, and the entire weight of the system is carried by the structural support frame.

Figure 3:
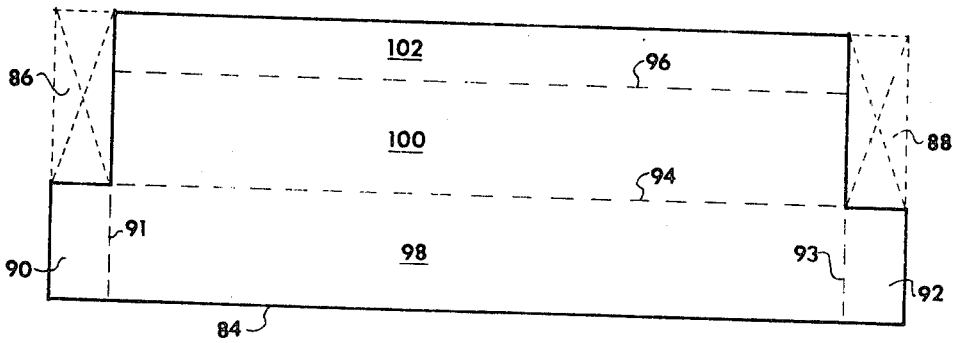
FIG. 3 is a plan view of one of the support runners for the underneath side of the skid after it has been die cut before folding and assembly.
Figure 4:
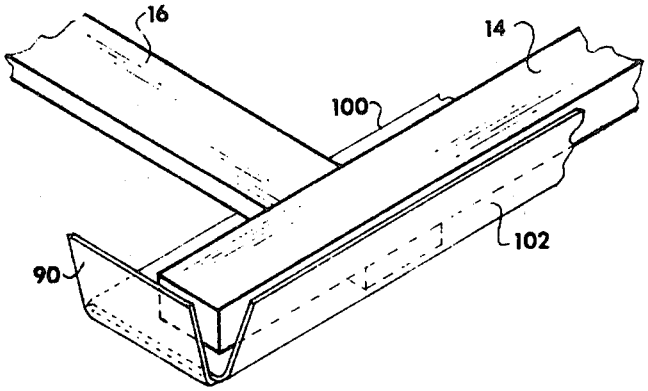
FIG. 4 is a perspective view of the runner of FIG. 3, except illustrating the runner after it is folded and ready for assembly onto the skid.

Turning now to FIGS. 3 and 4 there is illustrated the manner in which skis or runners 80,82 are formed. Since both runners are formed from an identical piece of die cut material, only one runner need be described. Looking at FIG. 3 runner 80 is die cut from a rectangular sheet 84 of corrugated. First of all the runners 80,82 will eventually include a lower or horizontal section which is secured to the lower surfaces of one of the footings 12,14. The horizontal section will be approximately eight inches wide. A vertical side section about four inches wide will fold up around the lower edge of the cover 50 and be secured thereto against the outside edge of one of the footings. The horizontal section should be a layer of double thickness as illustrated in FIG. 1.

Rectangular portions 86,88 are removed from the corners of the rectangular piece 84 of corrugated leaving a pair of ears 90,92 extending outwardly from a rectangular body portion of reduced length. Score lines or fold lines 91,93 are provided to separate the ear portions 90,92 from the remainder of the sheet 84. Additionally fold lines 94,96 are provided to divide the major portion of the sheet 84 into three major areas or panels 98, 100, and 102. It can now be seen in reference to FIG. 4 that major area 98 is folded beneath area 100 about fold line 94, and area 102 is folded up approximately 90° to provide a side securing wall by means of which the cover is secured.

The aforementioned construction of the runners 80,82 provides considerable economies in the fabrication thereof because previously the ears 90,92 extended outwardly from the middle panel 100, thereby requiring four areas to be die cut and removed rather than the two areas as now provided. As mentioned hereinabove, upon assemblage of the cover member 50 the side panels 102 and ears 90,92 are folded up and secure the lower edges of the cover member 50 to the skid 10. One feature of the structure according to the present invention is that the upper major flaps 60,62, and the ears 90,92 and side portion 102 of the runner 80 may be initially temporarily secured to the side rather than underneath of the cover to maintain the vehicle thereinside. Then, prior to shipment often times the manufacturer has omitted parts from the assembly inside and it is necessary to open the package to insert the omitted parts. With this arrangement the package may be opened either at the top or at the bottom by removing the temporary securing element, placing the articles within the package that have been previously ommited then permenantly securing the cover member to the skid by stitching or stapling in a conventional manner.

Since the side area or panel 102 folds up and staples are driven through layers of corrugated formed by panel 102, side walls 52 or 54, and into footing 12 or 14, there is no possibility of the side walls 52,54 slipping away from footings 12,14, in which case posts 68, 70, 72, 74 might slip out of engagement with footings 12 or 14 and the pier or pillar construction feature be lost.

One further feature should be noted that because of the ears 90,92 being folded from the ends the package may be slid either forwardly or backwardly since the rounded edges formed by folding up the ears permit movement either way. Also the double layer of corrugated material formed by panels 98,100 of runners 80,82 elevate the lower cross members 16, 18, 20, 22 of the skid above the floor sufficiently to allow slippage of the tynes of the fork-lift truck thereunder for easy maneuverability.

Figure 5:
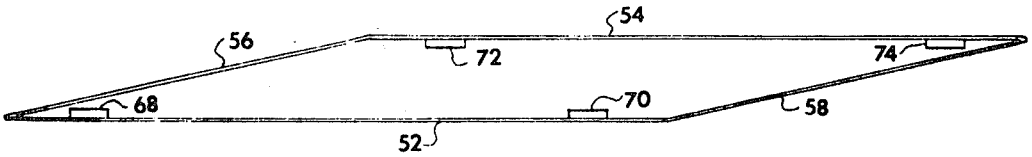
FIG. 5 is a perspective view illustrating the cover portion of the carton as it is folded for shipment prior to assembly and use as a package.

Finally, as illustrated in FIG. 5 the vertical posts 68, 70, 72, and 74 are so arranged on the inner surfaces of side walls 52,54 that when the carton is folded flat for ship to the manufacturer who is going to use the carton, no two of the vertical posts engage each other upon folding. That is to say, there is only one layer of wooden posts between the walls of the carton 50 when it is folded as illustrated in FIG. 5.

There is thus provided a significantly improved carton construction for the packaging of relatively large objects such as wheeled vehicles like garden tractors and the like. Although a preferred embodiment has been described very specifically and in detail hereinabove, it is obvious that various changes might be made to the specific structure described without departing from the scope of the invention which is set forth in the claims hereinbelow.

What is claimed is:

1. A packaging carton construction for large heavy objects, such as wheeled vehicles and the like, comprising:

(a) a rectangular skid formed of elongated structural members arranged with two spaced, parallel side members and a plurality of cross members connecting said side members;

(b) a cover member including opposed side walls, ends walls, a pair of upper major flaps secured to the edges of said side walls and a pair of upper minor end flaps secured to the upper edges of said end walls, said side walls and end walls terminating along the lower edges and being devoid of any lower flaps thereon;

(c) first securing means for maintaining the lower edges of the side walls of said cover member in assembled relation against the outer edges of said side members of said rectangular skid;

(d) said first securing means comprises a pair of spaced runners, each of said runners formed of corrugated box material and including a horizontal portion extending the length of the corresponding side member of said skid and having a side panel extending upwardly from the side edge of said horizontal portion and a pair of end panels being folded upwardly from opposite ends of said horizontal portion, said side and end panels being foldable upwardly around the lower edges of said side walls of said cover member and secured through the side and end walls of said cover into the skid to form said completed package;

whereby access to the lower portion of the interior of said carton is available after assembly of the object thereto without lifting the skid to add omitted parts of said heavy objects after packaging is substantially completed.

2. The packaging carton construction according to claim 1 wherein said horizontal portion of said runners comprises a double thickness of said corrugated material to space said skid a substantial portion above the support surface on which said carton is deposited.

3. The packaging carton construction according to claim 2 wherein said runner is formed from a sheet of said corrugated in the shape of a substantially rectangular member having a relatively narrow first side panel, a relatively wide central panel and a relatively wide opposite second side panel, said second side panel including an extension or ear longitudinally from either end thereof, said relatively wide second side panel being folded under said central panel, said relatively narrow first side panel and said extensions being folded upwardly to form said securing means to be secured against said cover member.

4. A packaging carton construction for wheeled vehicles and the like comprising:

(a) a rectangular skid formed of elongated structural members arranged with two spaced parallel side members and a plurality of cross members connecting said side members;

(b) a cover member including opposed side walls and end walls formed of a corrugated material which cover, upon assembly, is placed over said skid and substantially encloses the object therein;

(c) said cross members being divided into lower slats extending between and attached to the undersurfaces of said side rails and upper chocks being secured and attached to the upper surfaces of said side rails and extending therebetween, at least one of said chocks and one of said lower cross members being arranged in cooperating relationship to support the tires of one of the sets of wheels of said wheeled vehicle in elevated relationship from the bottom of said carton, and another one of said chocks and lower slats being arranged in cooperating relationship with each other to provide support for the other set of wheels of said vehicle, so that when positioned on said skid the wheels of said vehicle engage the cross members, thereby preventing shifting of the vehicle during the time it is in said carton.

5. The packaging carton construction according to claim 4 and further including additional lower slats located intermediate the wheel supporting slats, each of said interior slats being spaced from the opposite end of said carton a distance less than the length of the tynes of a conventional fork-lift truck.

* * * * *